US008625743B1

(12) United States Patent
Caiafa

(10) Patent No.: US 8,625,743 B1
(45) Date of Patent: Jan. 7, 2014

(54) INVERSE PULSE CONTROL FOR EDDY CURRENT ABATEMENT

(75) Inventor: Antonio Caiafa, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 277 days.

(21) Appl. No.: 13/096,841

(22) Filed: Apr. 28, 2011

(51) Int. Cl.
*H05G 1/32* (2006.01)
*H01J 35/06* (2006.01)

(52) U.S. Cl.
USPC ..... 378/137; 378/112

(58) Field of Classification Search
USPC ..... 378/16, 91, 93, 119, 121, 136, 137, 378/145, 204, 210, 111–115
See application file for complete search history.

(56) References Cited

U.S. PATENT DOCUMENTS

| | | | | |
|---|---|---|---|---|
| 4,125,772 | A * | 11/1978 | Holmes | 250/396 ML |
| 7,327,092 | B2 | 2/2008 | Caiafa et al. | |
| 7,439,682 | B2 | 10/2008 | Caiafa et al. | |
| 7,742,573 | B2 | 6/2010 | Caiafa | |
| 7,809,114 | B2 | 10/2010 | Zou et al. | |
| 7,826,594 | B2 | 11/2010 | Zou et al. | |
| 7,844,030 | B2 | 11/2010 | Wilson et al. | |
| 7,915,944 | B2 | 3/2011 | Caiafa et al. | |
| 2009/0041198 | A1 | 2/2009 | Price et al. | |
| 2010/0074392 | A1 * | 3/2010 | Behling et al. | 378/4 |

FOREIGN PATENT DOCUMENTS

| | | | |
|---|---|---|---|
| ES | 8800771 | A3 | 2/1988 |
| JP | 06114047 | A2 | 4/1994 |
| JP | 2001143882 | A | 5/2001 |
| JP | 2010016942 | A | 1/2010 |

* cited by examiner

*Primary Examiner* — Anastasia Midkiff
(74) *Attorney, Agent, or Firm* — Fletcher Yoder, P.C.

(57) ABSTRACT

The present embodiments are directed towards the abatement of eddy currents that develop in a conductive material as a result of rapidly switching the magnitude of a magnetic flux proximate the material. For example, in one embodiment, a system having a controller is provided. The controller is configured to apply voltage pulses to a magnetic coil, the magnetic coil being operable to steer an electron beam within a housing comprising conductive material. The voltage pulses include a first pulse configured to cause the magnetic coil to switch from generating a first magnetic flux to generating a second magnetic flux, and a second pulse configured to induce a first eddy current having substantially the same directional orientation as the first magnetic flux.

20 Claims, 9 Drawing Sheets

INVERSE PULSE CONTROL FOR EDDY CURRENT ABATEMENT

BACKGROUND

The subject matter disclosed herein relates to the controlled generation of X-rays and, more specifically, to the generation of X-rays from multiple perspectives.

In non-invasive imaging systems, X-ray tubes are used in both X-ray systems and computer tomography (CT) systems as a source of X-ray radiation. The radiation is emitted in response to control signals during inspection, examination or imaging sequences. Typically, the X-ray tube includes a cathode and an anode. An emitter within the cathode may emit a stream of electrons in response to heat and electric field resulting from an applied electrical current via the thermionic effect. The anode may include a target that is impacted by the stream of electrons. The target may, as a result, produce X-ray radiation and heat.

In such imaging systems, the radiation spans a subject of interest, such as a patient, baggage, or an article of manufacture, and a portion of the radiation impacts a detector or a photographic plate where the image data is collected. In some X-ray systems the photographic plate is then developed to produce an image which may be used by a quality control technician, security personnel, a radiologist or attending physician for diagnostic purposes. In digital X-ray systems a photodetector produces signals representative of the amount or intensity of radiation impacting discrete elements of a detector surface. The signals may then be processed to generate an image that may be displayed for review. In CT systems a detector array, including a series of detector elements, produces similar signals through various positions as a gantry is rotated about a patient. In certain configurations, a series of these signals may be used to generate a volumetric image. Generally, the quality of the volumetric image is dependent on the ability of the X-ray source and the X-ray detector to quickly generate data as they are rotated on the gantry.

In other systems, such as systems for oncological radiation treatment, a source of X-rays may be used to provide ionizing radiation to a tissue of interest of a patient. In some radiation treatment configurations, the source may also include an X-ray tube. X-ray tubes used for radiation treatment purposes may also include a thermionic emitter and a target anode that generates X-rays, such as described above. Such X-ray tubes or sources may also include one or more collimation features for focusing or limiting emitted X-rays into a beam of a desired size or shape. The X-ray source may be displaced about (e.g., rotated about) the tissue of interest while maintaining the focus of the X-ray beam on the tissue of interest, which allows a substantially constant X-ray flux to be provided to the tissue of interest while minimizing X-ray exposure to outlying tissue.

BRIEF DESCRIPTION

In one embodiment, an X-ray generating apparatus is provided. The X-ray generating apparatus includes an electron beam source configured to generate an electron beam along an electron beam path, an electron beam target capable of generating X-rays when impacted by the electron beam, and a housing having an electrically conductive material and configured to support the electron beam source and target. The apparatus also includes a magnetic coil disposed outside of the housing capable of being switched between generating at least a first magnetic field and a second magnetic field upon receiving voltage pulses, the first magnetic field having a first magnitude and the second magnetic field having a second magnitude, wherein the first magnetic field and the second magnetic field are configured to manipulate at least one of a size, a shape, or a direction of the electron beam along the electron beam path. The apparatus further includes a controller configured to apply the voltage pulses to the magnetic coil, wherein the voltage pulses include a first pulse configured to cause the coil to switch from generating the first magnetic field to generating the second magnetic field, and a second pulse configured to disrupt an eddy current generated in the electrically conductive material when switching between the first magnetic field and the second magnetic field.

In another embodiment, a system includes a coil having a superconducting magnetic material, the coil being capable of generating at least a first magnetic flux having a first directional orientation and a second magnetic flux having a second directional orientation. The coil is adapted to switch between generating the first magnetic flux and the second magnetic flux in response to applied voltage pulses. The system also includes an electrically conductive component disposed proximate the coil. The system further includes a controller configured to apply the voltage pulses to the coil. The voltage pulses include a first pulse configured to cause the coil to switch from generating the first magnetic flux to generating the second magnetic flux and a second pulse configured to disrupt an eddy current generated in the electrically conductive component when switching between the first magnetic flux and the second magnetic flux.

In a further embodiment, a system having a controller is provided. The controller is configured to apply voltage pulses to a magnetic coil, the magnetic coil being operable to steer an electron beam within a housing comprising conductive material. The voltage pulses include a first pulse configured to cause the magnetic coil to switch from generating a first magnetic flux to generating a second magnetic flux, and a second pulse configured to induce a first eddy current having substantially the same directional orientation as the first magnetic flux.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
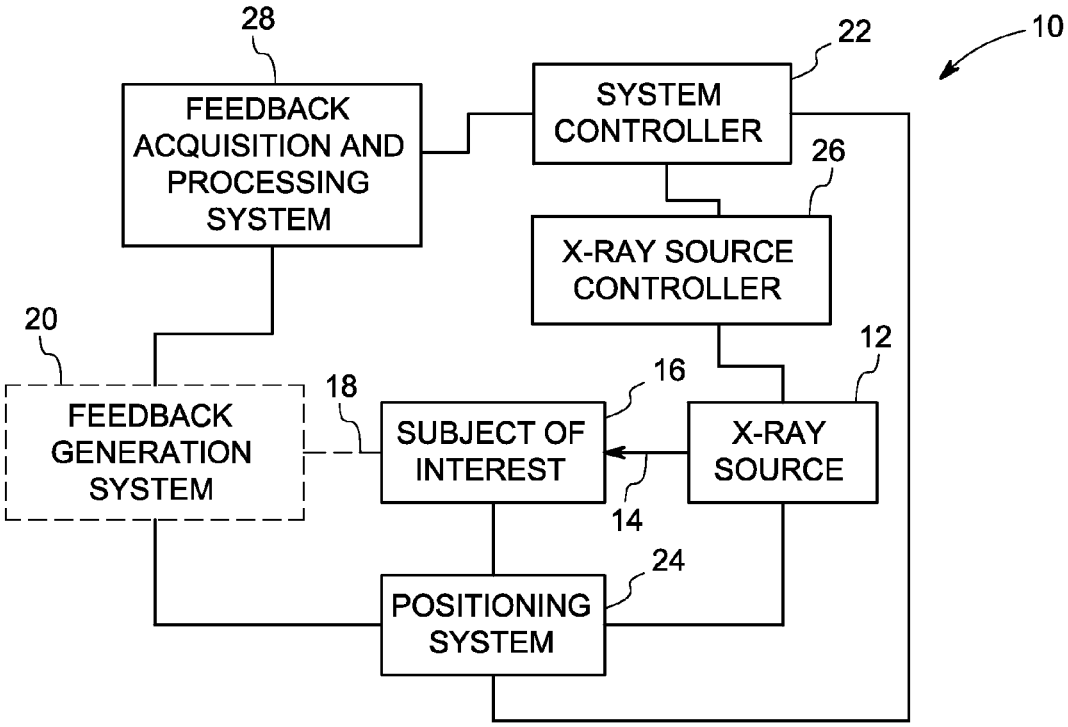
FIG. 1 is a block diagram illustrating an embodiment of a system that uses an X-ray source capable of emitting X-rays from multiple perspectives.

In the imaging and treatment modalities mentioned above, the quality of the examination/treatment procedures performed using X-ray producing sources may depend at least on the ability of the X-ray source to produce X-rays in a controlled manner. In certain X-ray sources, the electron beam that impacts the target anode to produce X-rays may be steered using a magnetic field applied across the X-ray source. Steering the electron beam may allow the X-ray source to emit X-rays from substantially constant or varying positions on the anode. Additionally or alternatively, the X-ray source may be focused by a quadrupole magnetic field. Such focusing may enable the focusing of variable energy X-ray emission, which can be useful for imaging different types of tissue and for providing varying levels of energy (e.g., in radiation treatment procedures). In configurations where it is desirable to emit the X-rays from varying positions on the anode and/or to focus the electron beam at different energies, the time delay between position changes or focal point maintenance may depend at least partially on the ability of the magnetic field that steers and/or focuses the electron beam to change its magnitude (e.g., orientation) and to interact with the electron beam. Unfortunately, rapidly changing the magnitude of the steering and/or focusing magnetic field may generate an eddy current in housings of X-ray sources that include a conductive material. Such eddy currents may reduce the magnitude of the desired steering magnetic field within the conductive housing of the X-ray tube during the transition between magnitudes, resulting in incorrect focusing of the electron beam on the anode target. In such situations, X-rays may be emitted from an undesired position on the anode, or at an undesired energy.

The approaches described herein provide embodiments for mitigating the effect of eddy currents generated within the conductive housing of X-ray sources when magnetic coils, such as those mentioned above, are pulsed (e.g., by applying a voltage pulse across the coils). The coils may be pulsed to change the magnitude (e.g., orientation) of a generated magnetic field. Therefore, the present embodiments are applicable to any change in magnetic field that results in the generation of an eddy current, such as in dipole magnetic field changes, quadrupole magnetic field changes, and the like. Specifically, certain of the disclosed embodiments provide systems and methods for performing voltage-based eddy current mitigation pulses. The mitigation pulses are applied to one or more magnetic coils to reduce or eliminate the eddy current generated from changing the magnitude (e.g., switching the orientation) of the magnetic field. Therefore, certain of the disclosed embodiments may allow faster magnetic field penetration of the X-ray source housing, faster steering of the electron beam, faster focusing, and, therefore, faster image production/tissue treatment and better image quality.

During the operation of certain of the X-ray tube embodiments disclosed herein, a first voltage pulse is applied to a magnetic coil. The first pulse changes the magnitude of the magnetic field generated by the coil, for example to change the direction of an electron beam focused towards an anode, or to maintain the focal area on the anode at different electron beam energies. The first pulse produces a first eddy current in the conductive housing of the X-ray tube, which may hinder the ability of the magnetic field to steer the electron beam. That is, the first eddy current reduces the magnetic field strength within the conductive housing during the transition. A second pulse that applies a voltage in an opposite direction compared to the first pulse is then applied to the coil. The second pulse may be different in amplitude and/or duration compared to the first pulse, and generates a second eddy current having an opposite orientation compared to the first eddy current. The second eddy current may reduce or altogether cancel the first eddy current, which enables faster penetration of the desired magnetic field through the housing. Such faster penetration enables faster steering of the electron beam. In certain embodiments, the second pulse may reduce the strength of the steering magnetic field across the housing. Accordingly, a third pulse that applies a voltage in substantially the same direction as the first pulse is then applied to the coil to maintain the magnetic field at a desired strength, or to return the magnetic field to the desired strength. The third pulse may be applied prior to or subsequent to the application of the second pulse.

Figure 2:
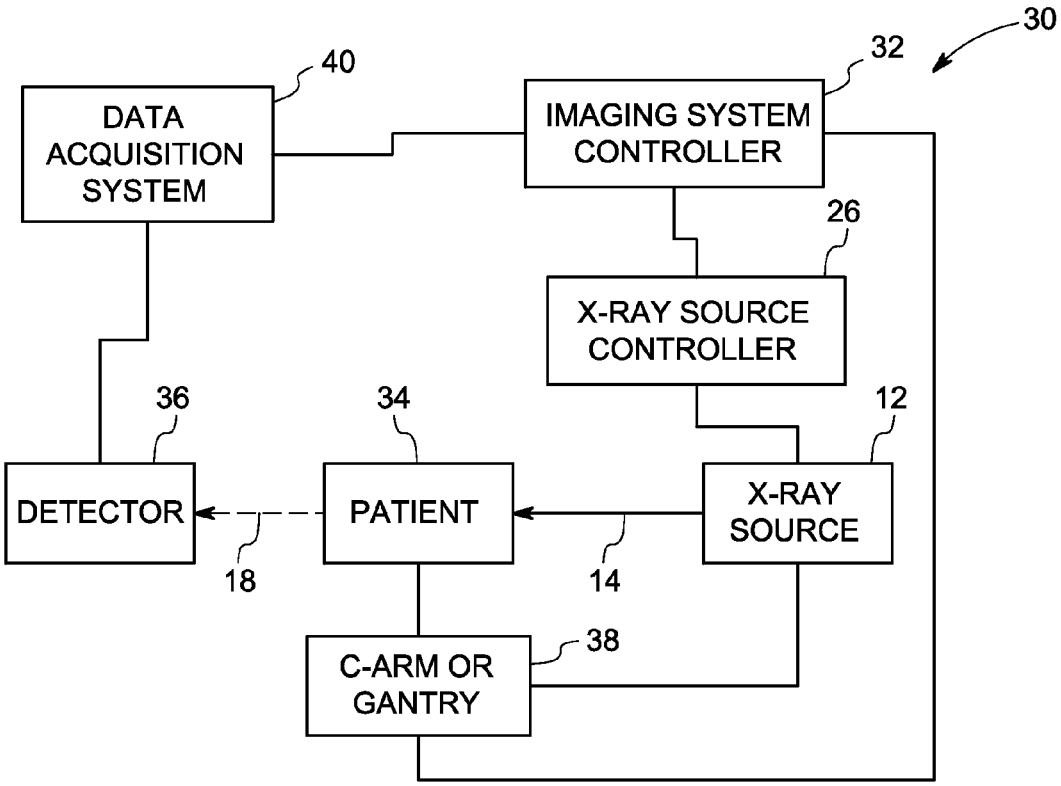
FIG. 2 is a block diagram illustrating an embodiment of an X-ray imaging system that uses an X-ray source capable of emitting X-rays from multiple perspectives.

The approaches described herein may be used in the contexts mentioned above, which can include non-invasive imaging, surgical navigation, radiation treatment, and so on. Accordingly, FIGS. 1 and 2 provide non-limiting examples of systems that may include and/or perform the disclosed pulses for mitigating eddy currents. Specifically, FIG. 1 is a block diagram illustrating a general system 10 that uses an X-ray radiation source 12 for performing a quality control, security, imaging, surgical, and/or treatment procedure. The X-ray radiation source 12 may include one or more X-ray tubes each having features for producing X-ray radiation from more than one perspective and/or more than one energy in a controlled manner as noted above. The X-ray source 12 therefore produces one or more streams of X-ray radiation 14 that are directed towards a subject of interest 16. The subject of interest may be baggage, cargo, an article of manufacture, a tissue of interest, and/or a patient. The X-ray radiation 14 is directed towards the subject of interest 16, where the X-ray radiation is attenuated to produce a beam of attenuated X-rays 18. The beam of attenuated X-rays 18 are captured by a feedback generation system 20 to produce signals representative of an image, or other information that may be useful for performing the procedure. Again, the data produced at the feedback generation system 20 may include data produced from receiving X-rays from a variety of positions and/or energies from each X-ray tube of the source 12.

A system controller 22 commands operation of the system 10 to execute examination, treatment and/or calibration protocols and to process the feedback. With respect to the X-ray source 12, the system controller 22 furnishes power, focal spot location, control signals and so forth, for the X-ray examination sequences. For example, the system controller 22 may furnish focal spot locations with respect to X-ray emissions from various perspectives by the X-ray source 12. Additionally, in some embodiments, the feedback generation system 20 is coupled to the system controller 22, which commands acquisition of the feedback. As will be discussed in further detail below, the system controller 22 may also control operation of a positioning system 24 that is used to move components of the system 10 and/or the subject 16. The system controller 22 may include signal processing circuitry and associated memory circuitry. In such embodiments, the memory circuitry may store programs, routines, and/or encoded algorithms executed by the system controller 22 to operate the system 10, including the X-ray source 12, and to process the feedback acquired by the generation system 20. In one embodiment, the system controller 22 may be implemented as all or part of a processor-based system such as a general purpose or application-specific computer system.

The source 12 may be controlled by an X-ray controller 26 contained within or otherwise connected to the system controller 22. The X-ray controller 26 is configured to provide power and timing signals to the source 12. In some embodiments the X-ray controller 26 may be configured to selectively activate the source 12 such that tubes or emitters at different locations within the system 10 may be operated in synchrony with one another or independent of one another. Moreover, in accordance with an aspect of the present disclosure, the X-ray controller 26 may provide control signals to magnetic coils proximate the X-ray tubes within the system 10. The control signals may cause each tube to emit X-ray radiation from multiple perspectives and/or multiple energies. The control signals may further be configured to mitigate eddy currents that are formed in the X-ray tube housing as a result of the magnetic steering/switching process noted above. According to the approaches described herein, the X-ray controller 26 may modulate activation or operation of one, two, three, four, or more magnetic coils disposed proximate each X-ray tube of the source 12. Therefore, the X-ray controller 26 may modulate the magnitude of a dipole and/or a quadrupole magnetic field.

As noted above, the X-ray source 12, which is controlled by the X-ray source controller 26, is positioned about the subject of interest 16 by the positioning system 24. The positioning system 24, as illustrated, is also connected to the feedback generation system 20. However, in other embodiments, the positioning system 24 may not be connected to the feedback generation system 20. The positioning system 24 may displace either or both of the X-ray source 12 and the feedback generation system 20 to allow the source 12 to image or treat the subject of interest 16 from a variety of positions. As an example, in a radiation treatment procedure, the positioning system 24 may substantially continuously displace the X-ray source 12 about the subject of interest 16, which may be a tissue of interest, while maintaining the focus of the X-ray radiation 14 generated from multiple perspectives on the tissue of interest. In this way, the tissue of interest is provided with a substantially continuous flux of X-ray radiation while X-ray exposure to outlying tissues is minimized. Moreover, while some systems may not produce diagnostic images of the patient, the feedback generation system 20 may generate data relating to the position of the X-ray source 12 or other features, such as a surgical tool, relative to the tissue of interest, for example as an image and/or map. Such data may enable a clinician or other healthcare provider to ensure that the X-ray radiation 14 and/or the surgical tool is properly located with respect to the tissue of interest. The feedback generation system 20 may include a detector, such as a diode array, or a system that monitors the position of the source 12 and/or surgical tool relative to the subject of interest 16. Indeed, in certain embodiments, the feedback generation system 20 may include a detector and position-monitoring features that also provide feedback to the positioning system 24 either directly or indirectly.

To provide feedback to features of the system 10 that are not directly connected to or associated with the feedback generation system 20, the feedback generation system 20 provides data signals to a feedback acquisition and processing system 28. The feedback acquisition and processing system 28 may include features for receiving feedback from the feedback generation system 20, as well as processing features for manipulating the received data. For example, the processing features may include signal converters (e.g., A/D converters), device drivers, processing chips, memory, and so on. In some embodiments, the feedback acquisition and processing system 28 converts analog signals received from the feedback generation system 20 into digital signals that can be further processed by one or more processing features (e.g., a computer-based processor) of the system controller 22.

One embodiment of system 10 is illustrated in FIG. 2, which is a block diagram of an embodiment of an X-ray imaging system 30, such as a CT or other radiographic imaging system. The system 30 includes an imaging system controller 32 for acquiring and processing projection data. The imaging system controller 32 also includes or is otherwise operatively connected to the X-ray source controller 26, which operates as described above. The X-ray source controller 26, as noted above, may also be operatively connected to one or more magnetic coils that are disposed proximate an X-ray tube of the source 12. The controller 26 may provide a series of voltage pulses to the magnetic coil to steer an electron beam produced within the X-ray tube, which allows X-rays to be generated from more than one area on a target anode of the X-ray tube.

Generally, the system 30 situates a patient 34 such that the X-ray beam 14 produced by the source 12 is attenuated by the patient 34 (e.g., various anatomies of interest) to produce the attenuated X-rays 18, which may be received by a photographic plate or a digital detector 36. In certain embodiments, the patient 34 may be situated in this manner using a C-arm or gantry 38, which is controllably connected to the imaging system controller 32. Generally, the imaging system controller 32 may synchronize certain imaging sequence parameters, such as emissions from the source 12 with rotation rates of the source 12 and detector 36 about the gantry.

The data that is generated at the detector 36 upon receiving the attenuated X-rays 18 is provided, as above, to processing features such as the illustrated data acquisition system (DAS) 40. The DAS 40 generally converts the data received from the detector 36 into a signal that can be processed at the imaging system controller 32 (or other computer based processor). As an example, the detector 36 may generate analog data signals upon receiving the attenuated X-rays 18, and the DAS 40 may convert the analog data signals to digital data signals for processing at the imaging system controller 32. The data may be used to generate one or more volumetric images of various anatomies within the patient 34.

Again, the quality of the produced volumetric images may at least partially depend on the ability of the X-ray source 12 to emit X-rays in a controlled manner. For example, the ability of the X-ray source 12 to quickly (e.g., on a milli- or microsecond timescale) change between emitting X-rays from different perspectives may enable the formation of volumetric images having fewer artifacts and higher resolution than images produced when such functionality is not present. Indeed, the imaging system controller 32 and the X-ray source controller 22 may be configured to generate multiple sets (e.g., a first set and a second set) of X-rays within about 1 to about 1000 microseconds of one another. In this way, a stereoscopic image may be formed using pairs of images (or pairs of projection data). Indeed, the present embodiments may enable X-ray emission from multiple perspectives within about 1 to about 750 microseconds, about 1 to about 500 microseconds, about 10 to about 250 microseconds, about 10 to about 100 microseconds, or about 20 to about 50 microseconds of one another.

Figure 3:
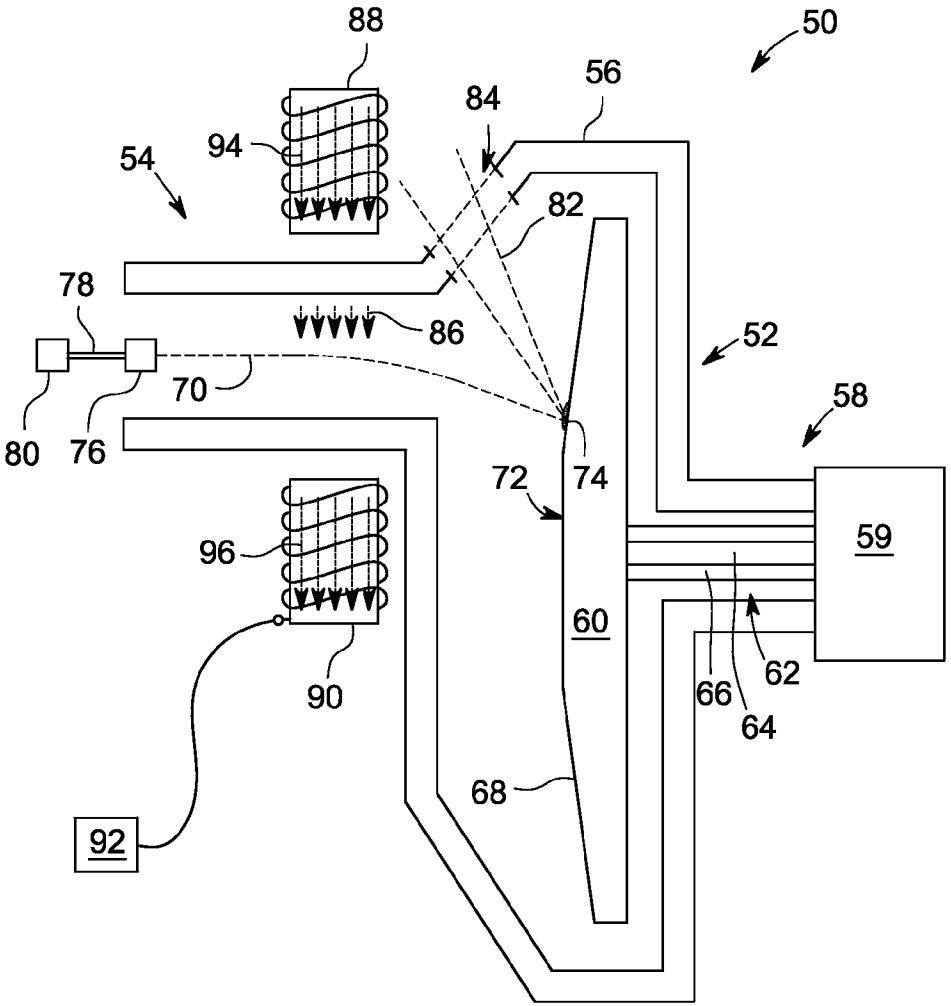
FIG. 3 is a schematic view of an embodiment of an X-ray tube configured to emit X-rays from multiple perspectives, and the X-ray tube is emitting X-rays in a first direction.
Figure 4:
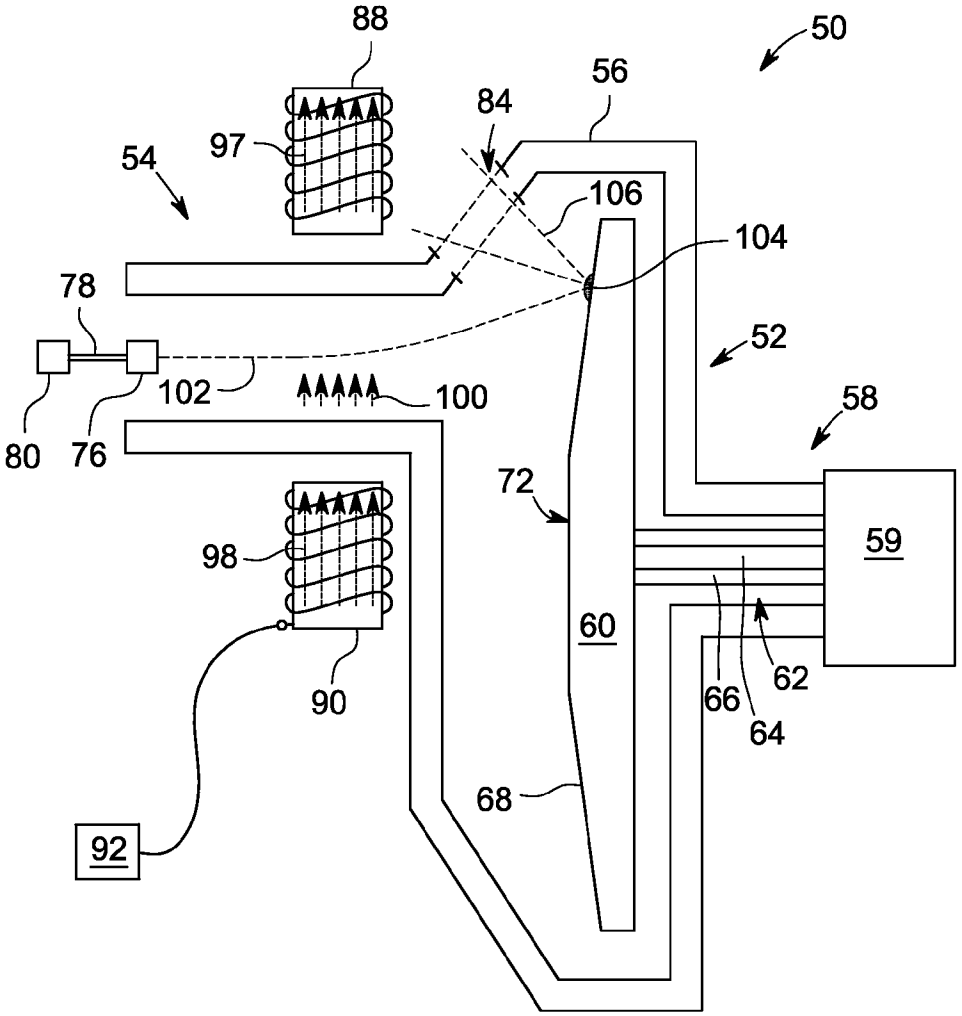
FIG. 4 is a schematic view of the embodiment of the X-ray tube of FIG. 3, and the X-ray tube is emitting X-rays in a second direction.

With the foregoing in mind, FIGS. 3 and 4 illustrate an embodiment of an X-ray tube 50 that includes features configured to provide X-ray emission from multiple perspectives and/or multiple energies. Specifically, FIG. 3 illustrates the X-ray tube 50 as emitting X-ray radiation from a first perspective and FIG. 4 illustrates the X-ray tube 50 as emitting X-ray radiation from a second perspective. However, it should be noted that the acts described herein are also applicable in the context of a quadrupole magnetic field configured to change the size (e.g., diameter) of an electron beam. Referring now to FIG. 3, The X-ray tube 50 includes an anode assembly 52 and a cathode assembly 54. The X-ray tube 50 is supported by the anode and cathode assemblies within a conductive or non-conductive housing 56 defining an area of relatively low pressure (e.g., a vacuum) compared to ambient. For example, the housing 56 may include glass, ceramics, stainless steel, or the like.

The anode assembly 52 generally includes rotational features 58 for causing rotation of an anode 60 during operation. The rotational features 58 may include a rotor and stator 59 for driving rotation, as well as a bearing 62 that supports the anode 60 in rotation. The bearing 62 may be a ball bearing, spiral groove bearing, or similar bearing. In general, the bearing 62 includes a stationary portion 64 and a rotary portion 66 to which the anode 60 is attached.

The front portion of the anode 60 is formed as a target disc having a target or focal surface 68 formed thereon. In accordance with an aspect of the present disclosure, the focal surface 68 is struck by an electron beam 70 at varying distances from a central area 72 of the anode 60. In the embodiment illustrated in FIG. 3, the focal surface 68 may be considered to be struck at a first position 74, while being struck in a second position in FIG. 4 as discussed below.

The anode 60 may be manufactured of any metal or composite, such as tungsten, molybdenum, copper, or any material that contributes to Bremsstrahlung (i.e., deceleration radiation) when bombarded with electrons. The anode's surface material is typically selected to have a relatively high refractory value so as to withstand the heat generated by electrons impacting the anode 60. The space between the cathode assembly 54 and the anode 60 may be evacuated in order to minimize electron collisions with other atoms and to maximize an electric potential between the cathode and anode. Moreover, such evacuation may advantageously allow a magnetic flux to quickly interact with (i.e., steer) the electron beam 70. In some X-ray tubes, voltages in excess of 20 kV are created between the cathode assembly 54 and the anode 60, causing electrons emitted by the cathode assembly 54 to become attracted to the anode 60.

Control signals are conveyed to cathode 76 via leads 78 from a controller 80, such as the X-ray controller 26. The control signals cause a thermionic filament of the cathode 76 to heat, which produces the electron beam 70. The beam 70 strikes the focal surface 68 at the first position 74, which results in the generation of a first set of X-ray radiation 82, which is diverted out of an X-ray aperture 84 of the X-ray tube 50. The first set of X-ray radiation 82 may be considered to have a respective first direction, or, in other contexts, a respective first energy, as is discussed in detail below. The direction, orientation, and/or energy of the first set of X-ray radiation 82 may be affected by the angle, placement, focal diameter, and/or energy at which the electron beam 70 impacts the focal surface 68.

Some or all of these parameters may be affected and/or controlled by a magnetic field 86 within the housing 56, which is produced outside of the X-ray tube 50. For example, first and second magnets 88, 90, which are disposed outside of the X-ray tube housing 56, may produce the magnetic field 86. In the illustrated embodiment, the first and second magnets 88, 90 are connected in series to a controller 92. The controller 92 provides electric current to the first and second magnets 88, 90, and may include or be a part of the system controller 22 or the X-ray controller 26 discussed above in FIGS. 1 and 2. As the electrical current is passed through the first and second magnets 88, 90, respective first and second magnetic fields 94, 96 are produced. The first and second magnetic fields 94, 96 both contribute to the dipole magnetic field 86 within the housing 56. In other embodiments, such as when a magnetic focusing system that uses a quadrupole field is included, the first and second magnetic fields 94, 96 may contribute to the quadrupole field. Indeed, in such embodiments, multiple magnets may be employed that are each capable of generating at least respective first and second magnetic fields. The respective magnetic fields may contribute to the overall quadrupole field.

In addition to providing the electric current, the controller 92 may also provide voltage pulses to the magnets 88, 90 to change the magnitude of the magnetic field 86. In certain embodiments, voltage pulses may also be provided to the first and second magnets 88, 90 to mitigate eddy currents that may be produced in the housing 56 when the magnitude of the magnetic field 86 is changed. The voltage pulses used to mitigate the eddy currents produced within the housing 56 may enable the production of a desired X-ray flux, X-ray energy, and/or X-ray direction. In the context of the present embodiment, such a mitigation pulse may allow the X-ray radiation to be emitted from a first perspective and/or focused at a first energy.

Thus, the first set of X-ray radiation 82, which may form all or a portion of the X-ray beam 18 of FIGS. 1 and 2, exits the tube 50 and is generally directed towards a subject of interest from the first perspective (or at the first energy) during examination and/or treatment procedures. As noted above, switching the magnitude (e.g., strength, orientation) of an externally generated magnetic field that is applied across the tube 50 may vary the direction or focusing strength at which X-rays are emitted from the X-ray tube 50. FIG. 4 illustrates an embodiment of the X-ray tube 50 after changing the orientation of the magnetic field 86. The embodiment of the X-ray tube 50 illustrated in FIG. 4 includes the same features as the X-ray tube 50 of FIG. 3. However, the magnetic field 86 has changed its orientation due to a change in magnitude as a result of a voltage pulse sequence provided to the magnets 88, 90. Specifically, the voltage pulse sequence has resulted in each of the magnets 88, 90 producing third and fourth magnetic fields 97, 98, which produces a second magnetic field 100. The second magnetic field 100 steers an electron beam 102 in a different direction than the electron beam 70 of FIG. 3. Therefore, the electron beam 102 impacts a second position 104 of the focal area 68 to produce a second set of X-rays 106. The second set of X-rays 106 is emitted in a second direction from the X-ray tube 50, and may traverse the subject of interest 16 along a path that is offset from the path of the first set of X-rays 82. In some embodiments, respective first and second projection data generated from the first and second sets of X-rays 84, 94 may be used to generate a stereoscopic and/or volumetric image.

Figure 5:
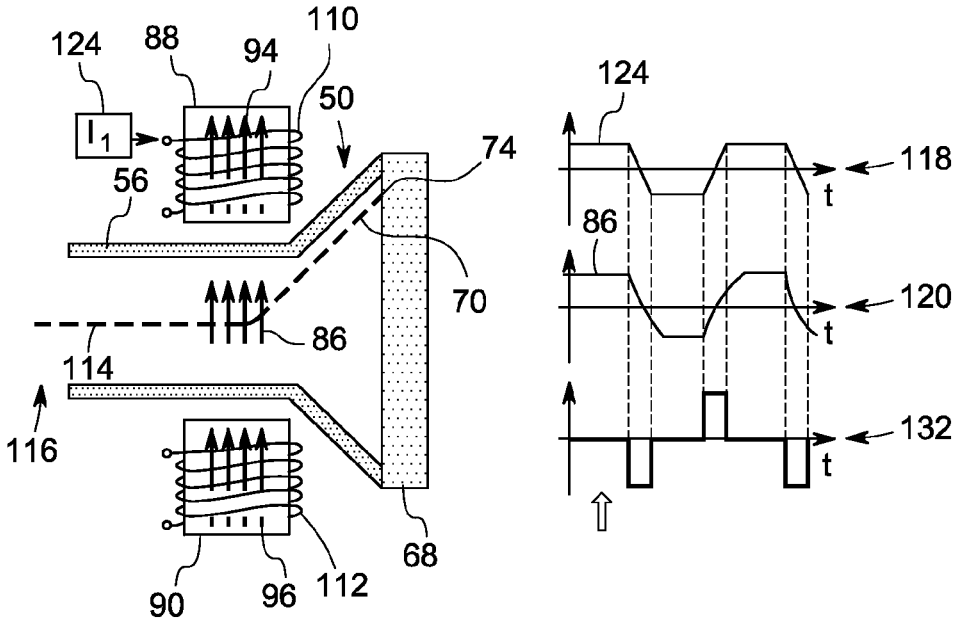
FIG. 5 is a schematic representation of an embodiment of an X-ray source configured to steer an electron beam within a conductive housing, and the X-ray source is steering the electron beam in a first direction.
Figure 6:
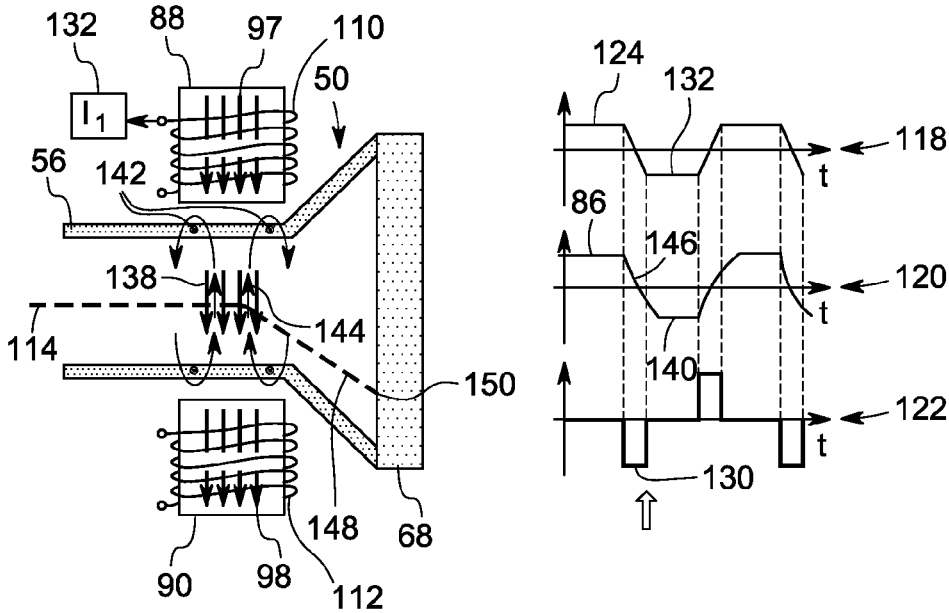
FIG. 6 is a schematic representation of the embodiment of the X-ray source of FIG. 5, and the X-ray source is steering the electron beam in an intermediate direction due to the formation of eddy currents.
Figure 7:
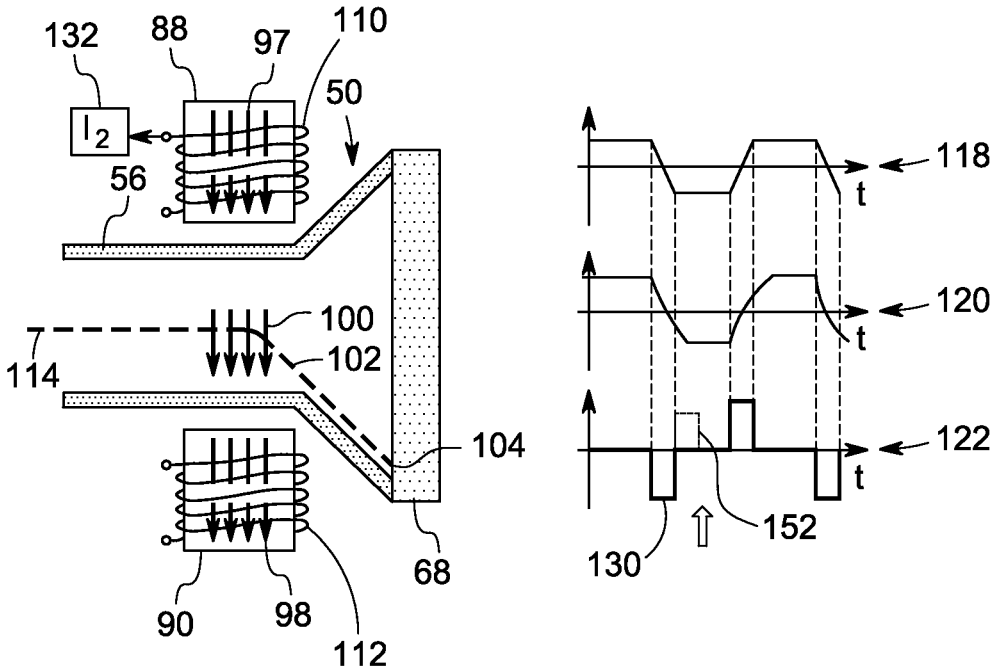
FIG. 7 is a schematic representation of the embodiment of the X-ray source of FIG. 5, and the X-ray source is steering the electron beam in a second direction.

In embodiments in which the housing 56 includes one or more conductive materials, changing the magnitude of the magnetic field may induce an eddy current in the housing 56. The eddy current reduces the magnitude of the desired field during the transient between the original magnitude and the desired magnitude. As noted above, such a reduction in the magnetic field can cause a slow and incomplete transition between producing the electron beam 70 and producing the electron beam 102. In embodiments in which the eddy current is not accounted for, an electron beam having an intermediate directionality and/or diameter will be emitted from the cathode assembly 54. FIGS. 5-7 illustrate the process of switching from producing the electron beam 70 to producing the electron beam 102. While the present approaches are described in the context of switching from electron beam 70 to electron beam 102, it should be noted that the embodiments disclosed herein are applicable to any process where a magnetic field is changed from one magnitude to another, such as to change the electron beam from one directionality and/or diameter to another. Therefore, it should be noted that the present discussion is also applicable to a magnitude adjustment of a quadrupole field, or any such adjustment of a magnetic flux.

Referring now to FIG. 5, an X-ray source during the process of producing X-rays is illustrated. Specifically, FIG. 5 illustrates a portion 100 of the X-ray tube 50 disposed between the first and second magnets 88, 90 having respective first and second coils 110, 112, which may include one or more superconductive magnetic materials. As illustrated, the combined magnetic field 86 generated by passing current through the coils 110, 112 is configured to steer an electron beam 114 produced at a cathode area 116. Steering the electron beam 114 generates the first electron beam 70, which is directed towards the first position 74 of the anode focal area 68 as noted above.

Proximate the portion 100 of the X-ray source 100 is illustrated a series of plots corresponding to a current 118, a magnetic field 120, and a voltage 122 corresponding to the operation of the portion 100 of the source. It should be noted, with regard to the plot of voltage 122, that in embodiments where the current and/or field (i.e., plots 118, 120) is constant, the voltage applied is minimal but not zero. Specifically, the voltage applied may be equal to R*I where R is the parasitic resistance of the coil and electronics connected to the coil, and I is the desired current through the coil. The position of each of the plots will be discussed as they relate to the process performed by the portion 100 of the source. To produce the first combined magnetic field 86, a first current 124 is passed through the first and second magnetic coils 110, 112. The first and second magnetic coils 110, 112 each generate respective local magnetic fluxes 94, 96, as noted above. The local magnetic fluxes each combine to generate the first combined magnetic field 86, which has a first orientation as represented by arrows. The orientation of the first combined magnetic field 86 defines the direction in which the electron beam 114 is steered.

To steer the electron beam 114 in another direction, different parameters are applied to the first and second magnetic coils 110, 112. FIG. 6 schematically illustrates the transition between generating electron beam 70 and electron beam 102. To change the magnitude (i.e., orientation) of the combined magnetic field 86 and steer the electron beam 114 in a different direction, a first voltage pulse 130 is applied across the first and second magnetic coils 88, 90. During the first voltage pulse 130, the current is changed from one value to another to adjust the magnitude of the applied magnetic field. In the illustrated embodiment, the first current 118 is reduced to a second current 132. Because the reduction from the first to the second current 132 results in a sign change of the current, the current is carried in an opposite direction across the coils 110, 112. As a result of the second current 132, the first and second magnetic coils 110, 112 produce second respective magnetic fluxes 97, 98, which combine to form a second combined magnetic field 138 in the X-ray tube 50 in a direction opposite from the first magnetic field 86. The amplitude and duration of the first voltage pulse 130 may correspond directly to a desired field strength 140 (i.e., the field strength corresponding to field 100 of FIG. 4) of the second combined magnetic field 138.

For the purposes of the present discussion, the housing 56 includes conductive materials. Therefore, an eddy current 142 may be generated upon applying the first voltage pulse 130. The eddy current 142 may produce a local magnetic field 144 that acts against and reduces the magnitude of the second combined magnetic field 138. This reduction is represented by a curve 146 in the plot 120 between the first combined magnetic field 86 and the desired value 140 of the second combined magnetic field 138. Indeed, the local magnetic field 144 produced by the eddy current 142 slows the transition from the first combined magnetic field 86 to the desired value of the second magnetic field 140. Therefore, the actual value of the second magnetic field 138 is represented as a value falling within the curve 146 of plot 120. Accordingly, rather than steering the electron beam 114 to generate electron beam 102, the electron beam 114 is steered to produce an electron beam 148 that impacts an intermediate position 150 between the first and second positions 74, 104 of the focal area 68. As noted above, such inadvertent steering may be undesirable, as X-rays may be emitted from the tube 50 in an undesired direction, and the target 68 may overheat.

As the second current 132 is maintained through the magnetic coils 110, 112, the eddy current 142 reduces and eventually has substantially no effect on the second magnetic field 138. Therefore, the electron beam 114 is steered by the second combined magnetic field 138 having the desired field value 140, which corresponds to the field 100 in FIG. 4, to generate the electron beam 102, as illustrated in FIG. 7. In accordance with presently contemplated embodiments, the reduction of the eddy current 142 may be accelerated by the application of a second voltage pulse 152 having an opposite orientation compared to the first voltage pulse 130. The amplitude and duration of the second voltage pulse 152 may depend on the magnitude of the eddy current 142, the desired magnetic field value 140, and the temperature of the X-ray tube 50, among other factors. As illustrated in the plots 118, 120, 122, the steering, focusing, and direction-changing process may be repeated by applying voltage pulses of varying direction across the coils 110, 112.

Figure 8:
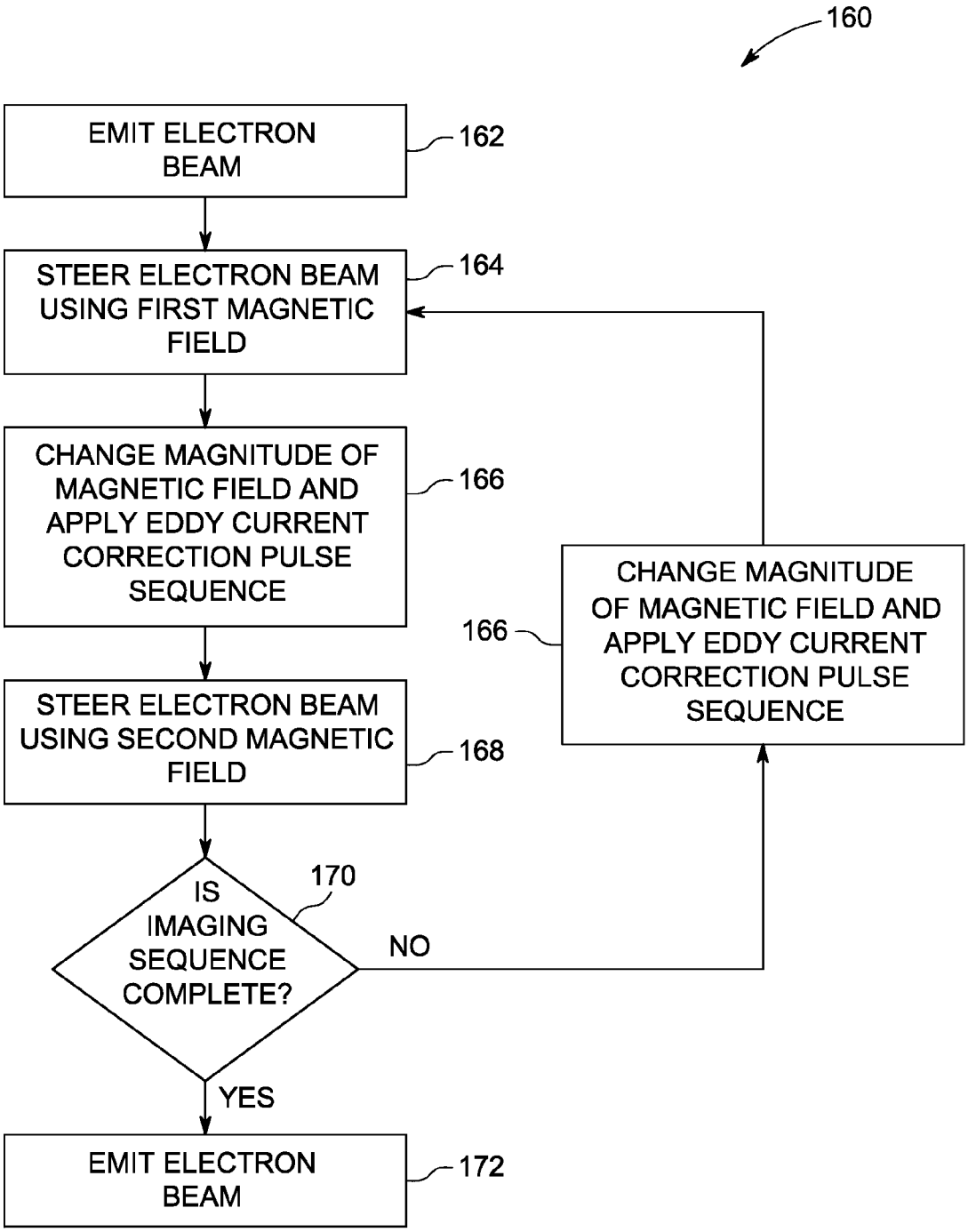
FIG. 8 is a process flow diagram illustrating an embodiment of a method for steering an electron beam between at least a first and a second direction using one or more magnetic coils.

Indeed, the steering, focusing, and direction-changing process may be repeated a number of times during an imaging process. FIG. 8 is a process flow diagram illustrating an embodiment of a method 160 for controlling the directionality and/or focus of an electron beam within an X-ray tube. Therefore, method 160 may be considered to be a process for changing the direction of an electron beam with a dipole or quadrupole field, or compressing/decompressing an electron beam with a quadrupole field. A suitably configured controller, such as the system controllers 22, 32, and/or the X-ray source controller 26 of FIGS. 1 and 2, and/or controller 80 may perform the method 160 in conjunction with the hardware (e.g., X-ray tubes and magnetic coils) discussed herein. The method 160 begins with the emission of an electron beam (block 162), such as the electron beam 108. Again, as noted above, control signals may be provided from an X-ray source controller to a cathode assembly. The control signals direct the cathode assembly to produce the electron beam.

In many instances, a magnetic field will already be applied to the X-ray source by one or more magnetic coils prior to the first emission of the electron beam. Therefore, the electron beam will be steered (e.g., in a first direction) or compressed (e.g., to a first section) using such a first magnetic field (block 164). As noted above with respect to FIGS. 3-7, the directionality and/or diameter of the electron beam depends at least on the magnitude of the applied magnetic field.

Once a desired amount of X-rays have been produced by bombardment of the anode 60 with the electron beam, the direction, energy, and/or compression of the electron beam may be changed. That is, in accordance with the disclosed approaches, a series of pulses are applied to the magnetic coils to change the magnitude of the first magnetic field and to offset the deleterious effects of the eddy current that is generated from changing the magnitude of the magnetic field (block 166). The acts represented by block 166 will be discussed in further detail below with respect to FIGS. 9-12.

Substantially concomitantly and/or subsequent to performing the acts of block 166, the electron beam is steered in a second direction using the second magnetic field (block 168). The second magnetic field is produced by changing the magnitude of the first magnetic field in block 166. Upon generating a desired amount of X-rays in the second direction, a query is performed to determine if the imaging sequence is complete (query 170). In embodiments in which the imaging sequence is complete, electron beam emission may cease (block 172). However, in embodiments in which the imaging sequence is not complete, it may be desirable to again change the direction and/or compression of the electron beam.

Accordingly, the magnitude of the magnetic field is changed using a voltage pulse. Additionally, a pulse sequence is performed to account for the eddy current produced by changing the magnitude of the magnetic field (block 166). The method then cycles back to the acts represented by block 164, and the method 160 then performs the acts described above. Generally, it may be desirable to perform the method 160 such that X-rays are generated from the first and second directions and/or energies to generate pairs of projection. However, in certain embodiments, the method 160 may cease after performing the acts represented by block 164. In such embodiments, unpaired sets of projection data may be produced.

Figure 9:
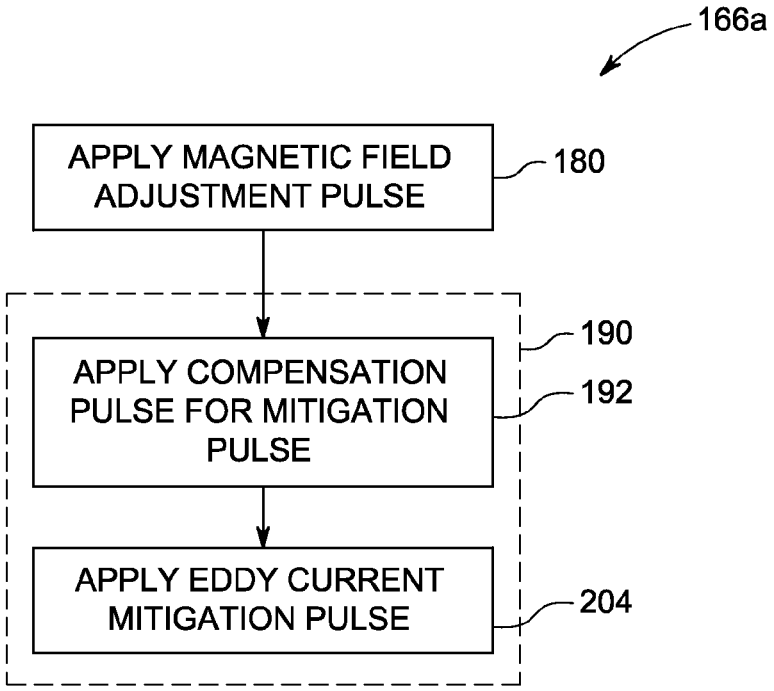
FIG. 9 is a process flow diagram illustrating an embodiment of the step for changing the direction of the electron beam of FIG. 8.
Figure 10:
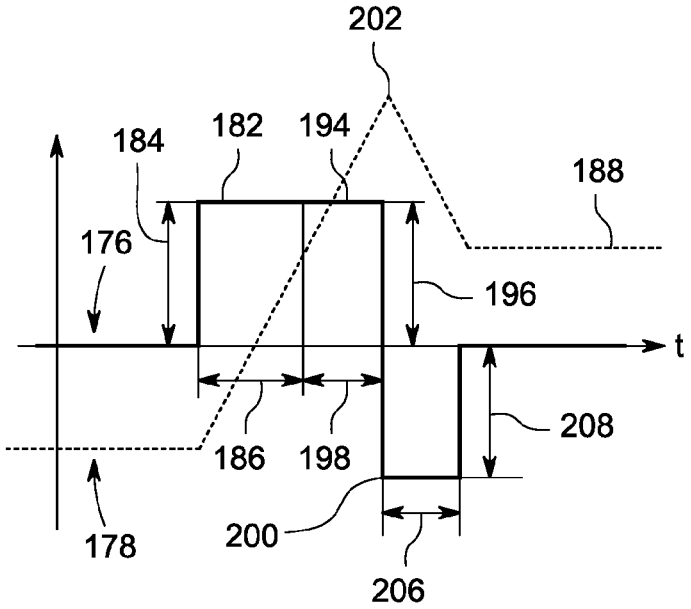
FIG. 10 is an embodiment of a combined plot representing voltage pulses used in the method of FIG. 9 and the magnetic field that results from performing the voltage pulses.
Figure 11:
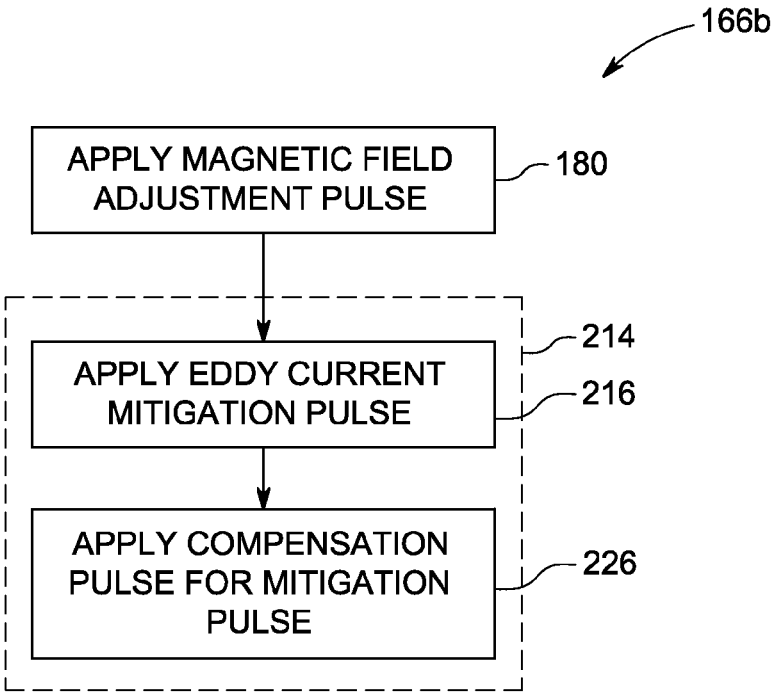
FIG. 11 is a process flow diagram illustrating another embodiment of the step for changing the direction of the electron beam of FIG. 8.

FIGS. 9 and 11 are process flow diagrams illustrating embodiments of the acts represented by block 166 of FIG. 8. Specifically, FIGS. 9 and 11 illustrate methods 166*a* and 166*b*, respectively, for changing the magnitude of a magnetic field and mitigating the eddy current that results. FIGS. 10 and 11 each illustrate a plot 176 of voltage pulses and a plot 178 of the current into the magnets (e.g., magnetic coils 110, 112) as the methods 166*a* and 166*b* are performed, respectively. Referring now to FIG. 9, the method 166*a* begins with applying a magnetic field adjustment voltage pulse (block 180). The magnetic field adjustment voltage pulse changes the magnitude of the current flowing through the magnetic coils, which causes the magnitude of the magnetic field generated by the coils to change. In embodiments where the magnitude change is sufficient to change the direction in which the current is flowed through the magnets, the directional orientation of the field may change. In FIG. 10, the plot 176 of the voltage illustrates the magnetic field adjustment pulse as a first pulse 182 that is applied at a positive amplitude 184 and for a certain duration 186. As noted above, the amplitude 184 and the duration 186 may correspond to the desired field strength of the second magnetic field. More specifically, an area defined by the amplitude 184 multiplied by the duration 186 may relate to (e.g., correspond or be proportional to) the desired field strength.

For example, as illustrated in FIG. 10, upon applying the first voltage pulse 182, the current applied to the magnets rises beginning with the application of the first voltage pulse. Again, as noted above, a desired field strength may not be reached at the end of the duration 186 of the first pulse 182, even though the current through the magnets is at a desired level 188. This time delay may result from the limitations of the hardware (e.g., the response of the magnetic coils), as well as the eddy current 142 discussed above.

Returning to FIG. 9, upon applying the magnetic field adjustment pulse (block 180), as noted above, an eddy current may be produced. To offset the effects of the eddy current, a reverse pulse technique (block 190) is performed. The reverse pulse technique (block 190) includes at least a pair of voltage pulses, one of which has a reverse amplitude compared to the other or others. As illustrated, the reverse pulse technique of block 190 includes the step of applying a compensation pulse (block 192) for an eddy current mitigation pulse that will be applied. For example, the eddy current mitigation pulse may act to reduce the field strength of the magnetic field. The compensation pulse temporarily increases the field strength of the magnetic field beyond the desired field strength, and allows the eddy current mitigation pulse to reduce the field strength of the magnetic field down to the desired field strength 188. In the embodiment of FIG. 9, the compensation pulse may be considered to be a second pulse 194, which is illustrated in FIG. 10.

In FIG. 10, the voltage plot 176 illustrates the second pulse 194 as having a duration 198 and an amplitude 196. In certain embodiments, an area defined by the product of the duration 198 and the amplitude 196 of the second pulse 194 may be substantially the same as an area of a third pulse 200, which is the eddy current mitigation pulse. The second pulse 194 increases the current through the magnets beyond the desired current 188 to a maximum current 202. In the illustrated embodiment, the maximum current 202 is reached at the end of the duration 198 of the second pulse 194. The third pulse 200 reduces current to the desired current 188, which results in the production of the desired magnetic field.

Returning to FIG. 9, in the illustrated embodiment, after the compensation pulse has been applied to the magnetic coils (block 192), the eddy current mitigation pulse is applied to the magnetic coils (block 204). The eddy current mitigation pulse is a voltage pulse applied in an opposite direction across the magnetic coils compared to the magnetic field adjustment pulse and the compensation pulse. The eddy current mitigation pulse, as noted above, produces another eddy current to offset the effects of the eddy current generated by performing the acts represented by block 180. Upon application of the eddy current mitigation pulse (block 204), the method 166*a* is completed and the method 160 of FIG. 8 is continued.

As illustrated in FIG. 10, the end of a duration 206 of the third pulse corresponds to the reduction of the current level to the desired current level 188, which eventually produces the desired magnetic field strength. Because the third pulse 200 is intended to mitigate the eddy currents generated by changing the magnetic field magnitude, it may be desirable to monitor the eddy currents so produced, or one or more parameters indicative of the eddy currents. Indeed, an area defined by the duration 206 and an amplitude 208 of the third pulse 200 may be determined based upon the eddy currents generated by the acts represented by block 180, as well as the temperature of the X-ray tube. Therefore, using various modeling techniques, the duration 206 and the amplitude 208 of the third pulse 200 may be determined using a transfer function, a look-up table, or the like, based upon the measured eddy currents and/or the measured parameters. As noted above, the area defined by the duration 206 and the amplitude 208 of the third pulse 200 determines the area of the second pulse 194, which prepares the magnetic field for a reduction in field strength.

Figure 12:
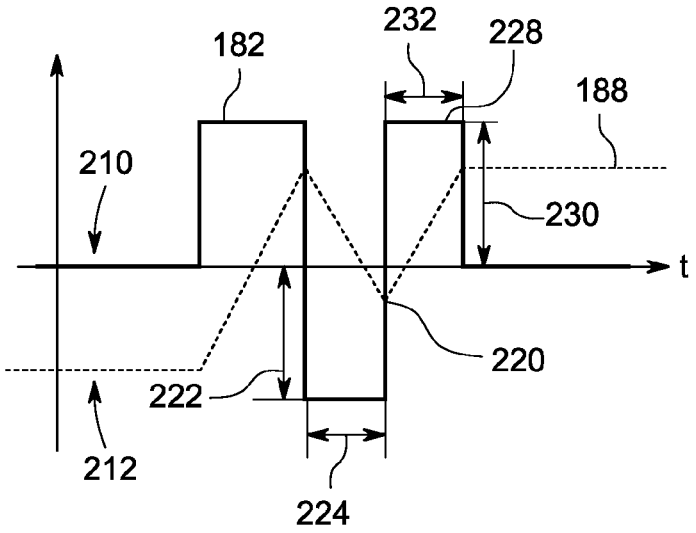
FIG. 12 is an embodiment of a combined plot representing voltage pulses used in the method of FIG. 11 and the magnetic field that results from performing the voltage pulses.

Rather than performing a preliminary compensation pulse as discussed above, it may be desirable to compensate the magnetic field strength after it has been reduced by the eddy current mitigation pulse. FIG. 11 is a process flow diagram of an embodiment of such a method 166*b* for changing the magnetic field magnitude and mitigating produced eddy currents. FIG. 12 illustrates plots of voltage 210 and current through the magnets 212 as the method 166*b* is performed. Referring now to FIG. 11, at the onset of the method 166*b*, the magnetic field adjustment pulse is applied (block 180). The magnetic field adjustment pulse, as discussed above, may be considered to be the first voltage pulse 182, which produces an eddy current.

After performing the acts represented by block 180, a reverse pulse technique may be performed (block 214) to offset the eddy current that is produced by the rapid change in magnetic field magnitude. The reverse pulse technique 214 of method 166*b* begins with the application of the eddy current mitigation pulse (block 216). In FIG. 12, the eddy current mitigation pulse is a second voltage pulse 218 that reduces the current to a local minimum value 220 and, therefore, reduces the magnetic field strength. In this case, the eddy current mitigation pulse has an area defined by an amplitude 222 and duration 224 that is related to the eddy current produced by the acts of block 180 plus additional eddy currents in the reversed direction that may be cancelled by the pulse 228.

Figure 13:
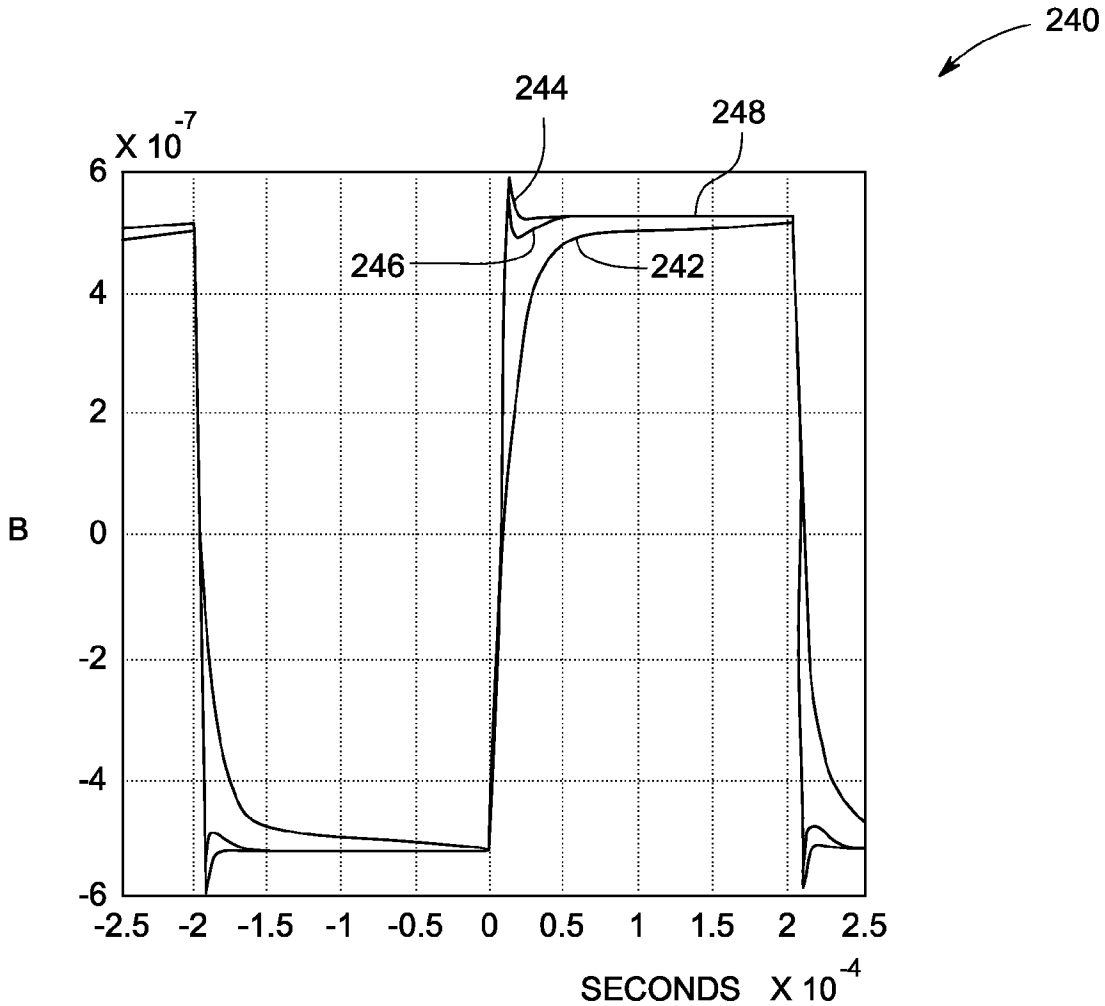
FIG. 13 is a combined plot of experimental data obtained for a magnetic field when the methods of FIGS. 9 and 11 are performed, as well as experimental data for the magnetic field obtained when neither method is performed.

Returning to FIG. 11, upon application of the eddy current mitigation pulse (block 216), a compensation pulse is applied (block 226). The compensation pulse, which is represented as a third pulse 228 in FIG. 12, has an area defined by the product of an amplitude 230 and a duration 232. In some embodiments, the area may be proportional to the area of the second pulse 218. The third pulse 228 acts to return the field strength of the magnetic field to the desired field strength by increasing the current to the desired level 188. Moreover, the third pulse 228 cancels the eddy currents created by the second pulse 224. Upon application of the compensation pulse (block 226) the eddy currents will be completely compensated As noted above, the present approaches may enable an electron beam within an X-ray tube to be rapidly steered between directions and/or rapidly compressed/decompressed. Specifically, the strength of a magnetic field may be rapidly changed by increasing the speed of field penetration through the housing of the X-ray tube. FIG. 13 illustrates a plot 240 of experimental data obtained using the reverse pulse methods described above with respect to FIG. 9 using different timing as well as data obtained without using such methods.

Specifically, plot 240 illustrates a plot of magnetic field strength within an X-ray tube versus time as the orientation of the magnetic field is changed upon applying a suitable reversal voltage pulse. A line 242 may be considered a baseline, where the described reverse pulse methods are not performed. A line 244 corresponds to experimental data obtained by performing the method 166*a* of FIG. 9 wherein the pulses are performed for a duration of 2 microseconds each, and a line 246 corresponds to experimental data obtained by performing the same but with a duration of 1.8 microseconds per pulse. As illustrated, the line 242 shows that the magnetic field increases after the application of the magnetic field reversal pulse (e.g., pulse 182 of FIGS. 10 and 12). As a result of unabated eddy currents, the line 242 fails to reach a desired field strength 248 before the beginning of a new pulse sequence. Such insufficient field strength may result in an undesired steering or compression/decompression of an electron beam.

Conversely, the line 244 surpasses the desired field strength 248 and is subsequently reduced to the desired field strength 248. As noted above, the method 166*a* includes the application of a pair of pulses to the steering magnetic coils. The pair of pulses includes a preparation pulse that increases the field strength beyond the desired field strength 248, followed by a disruption pulse that reduces the field strength to the desired field strength 248 and also disrupts eddy currents formed by the reversal pulse, as discussed above with respect to FIGS. 9 and 10. The effectiveness of the method 166*a* is demonstrated in that line 244 reaches and maintains a level at the desired field strength 248 approximately 10 microseconds after the magnetic field reverse pulse is initiated.

In a similar manner, the line 246 that corresponds to the method 166*a* but with a slightly different duration for each pulse reduces the field strength below the desired field strength 248, and subsequently increases the field strength to the desired field strength. The timing shown here, as noted above, includes the application of a pair of pulses to the steering magnetic coils. The effectiveness of one approach described herein is demonstrated in that line 246 reaches and maintains a level at the desired field strength 248 approximately 10 microseconds after the magnetic field reverse pulse is initiated. Indeed, the present approaches enable a desired field strength to be reached and maintained within about 100, 90, 80, 70, 60, 50, 40, 30, 20, or 10 microseconds after the onset of a magnetic field reversal pulse.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An X-ray generating apparatus, comprising:

an electron beam source configured to generate an electron beam along an electron beam path;

an electron beam target capable of generating X-rays when impacted by the electron beam;

a housing comprising an electrically conductive material and configured to support the electron beam source and target;

a magnetic coil disposed outside of the housing capable of being switched between generating at least a first magnetic field and a second magnetic field upon receiving voltage pulses, the first magnetic field having a first magnitude and the second magnetic field having a second magnitude, wherein the first magnetic field and the second magnetic field are configured to manipulate at least one of a size, a shape, or a direction of the electron beam along the electron beam path; and a controller configured to apply the voltage pulses to the magnetic coil, wherein the voltage pulses comprise a first pulse configured to cause the coil to switch from generating the first magnetic field to generating the second magnetic field, and a second pulse configured to disrupt an eddy current generated in the electrically conductive material when switching between the first magnetic field and the second magnetic field.

2. The apparatus of claim 1, wherein the first pulse and the second pulse comprise voltages placed in opposite directions across the magnetic coil, the first magnetic field has a first directional orientation and the second magnetic field has a second directional orientation substantially opposite the first and the first and second magnetic fields are configured to steer the electron beam between at least a first focal point and a second focal point on the electron beam target.

3. The apparatus of claim 1, wherein the voltage pulses comprise a third pulse configured to offset a reduction in magnitude of the second magnetic flux caused by the second pulse, and the second pulse has a first area defined by the product of a first amplitude and a first duration in a plot of voltage as a function of time and the third pulse has a second area defined by the product of a second amplitude and a second duration in the plot of voltage as a function of time, and the first area and the second area are substantially the same.

4. The apparatus of claim 1, wherein the first magnetic field contributes to a first quadrupole field and the second magnetic field contributes to a second quadrupole field, the first and second quadrupole fields being capable of adjusting a focal area of the electron beam by adjusting the size of the electron beam along the electron beam path.

5. The apparatus of claim 1, wherein the voltage pulses comprise a third pulse configured to offset a reduction in magnitude of the second magnetic flux caused by the second pulse.

6. The apparatus of claim 5, wherein the third pulse is performed prior to performing the second pulse.

7. The apparatus of claim 5, wherein the second pulse is performed prior to performing the third pulse.

8. The apparatus of claim 1, comprising one or more additional magnetic coils disposed outside of the housing opposite the magnetic coil, each of the one or more additional magnetic coils being capable of switching between generating at least a respective third magnetic field and a respective fourth magnetic field upon receiving additional voltage pulses, the respective third magnetic field having a respective third magnitude and the fourth magnetic field having a respective fourth magnitude, and wherein the respective third magnitude and the respective fourth magnitude are substantially the same as the first magnitude and the second magnitude, respectively, and the first and third magnetic fields contribute to a first quadrupole field to focus the electron beam when the electron beam is at a first energy, and the second and fourth magnetic fields contribute to a second quadrupole field to focus the electron beam when the electron beam is at a second energy.

9. The apparatus of claim 8, wherein the voltage pulses and the additional voltage pulses are substantially the same, and the controller is configured to provide the additional voltage pulses to the additional magnetic coil in concert with applying the voltage pulses to the magnetic coil.

10. A system, comprising:

a coil comprising a superconducting magnetic material and capable of generating at least a first magnetic field having a first magnitude and a second magnetic field having a second magnitude, wherein the coil is adapted to switch between generating the first magnetic field and the second magnetic field in response to applied voltage pulses;

an electrically conductive component disposed proximate the coil; and a controller configured to apply the voltage pulses to the coil, the voltage pulses comprising a first pulse configured to cause the coil to switch from generating the first magnetic field to generating the second magnetic field, and a second pulse configured to disrupt an eddy current generated in the electrically conductive component when switching between the first magnetic field and the second magnetic field.

11. The system of claim 10, wherein the voltage pulses comprise a third pulse configured to offset a reduction in magnitude of the second magnetic flux caused by the second pulse.

12. The system of claim 11, wherein the second voltage pulse has a first area defined by the product of a first amplitude and a first duration in a plot of voltage as a function of time and the third voltage pulse has a second area defined by the product of a second amplitude and a second duration in the plot of voltage as a function of time, and the first area and the second area are substantially the same.

13. The system of claim 10, comprising an X-ray tube having the electrically conductive component as a housing and comprising an electron beam source configured to emit an electron beam and an electron beam target configured to generate X-rays in response to encountering the electron beam, and the electron beam source and the electron beam target are disposed in the housing, wherein the first magnetic field and the second magnetic field are configured to adjust at least one of a size, shape, or a direction of the electron beam.

14. The system of claim 13, wherein the first magnetic field contributes to a first quadrupole field and the second magnetic field contributes to a second quadrupole field, the first and second quadrupole fields being capable of adjusting a focal area of the electron beam by adjusting the size of the electron beam along the electron beam path.

15. The system of claim 13, wherein the first magnetic field contributes to a first dipole field and the second magnetic field contributes to a second dipole field, the first and second dipole fields being capable of steering the electron beam between focal spots on the electron beam target to emit a first set of X-rays and a second set of X-rays, respectively, from the X-ray tube.

16. The system of claim 15, comprising an X-ray detector, and the first set of X-rays are configured to traverse a subject of interest from a first perspective to generate a first set of attenuated X-rays and the second set of X-rays are configured to traverse the subject of interest from a second perspective to generate a second set of attenuated X-rays, wherein the X-ray detector is configured to generate signals in response to the first set of attenuated X-rays and the second set of attenuated X-rays.

17. A system, comprising:

a controller configured to apply voltage pulses to a magnetic coil, the magnetic coil being operable to steer an electron beam within a housing comprising conductive material, wherein the voltage pulses comprise a first pulse configured to cause the magnetic coil to switch from generating a first magnetic field to generating a second magnetic field, and a second pulse configured to disrupt a first eddy current having substantially the same directional orientation as the first magnetic field.

18. The system of claim 17, wherein the first pulse and the second pulse comprise voltages placed in opposite directions across the magnetic coil.

19. The system of claim 17, wherein the voltage pulses comprise a third pulse configured to offset a reduction in magnitude of the second magnetic flux caused by the second pulse.

20. The system of claim 17, wherein when the first pulse is applied to the magnetic coil to switch the magnetic coil from generating the first magnetic field to generating the second magnetic field, a second eddy current is generated having an opposite directional orientation from the second magnetic field, and the second eddy current is configured to disrupt the first eddy current.

* * * * *